US012018531B2

(12) United States Patent
Voglewede et al.

(10) Patent No.: US 12,018,531 B2
(45) Date of Patent: Jun. 25, 2024

(54) EARTH-BORING DRILL BIT MANDREL FORMED BY ADDITIVE MANUFACTURING

(71) Applicant: Halliburton Energy Services, Inc., Houston, TX (US)

(72) Inventors: Daniel Brendan Voglewede, Spring, TX (US); Yi Pan, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 165 days.

(21) Appl. No.: 17/615,620

(22) PCT Filed: Aug. 8, 2019

(86) PCT No.: PCT/US2019/045699
§ 371 (c)(1),
(2) Date: Dec. 1, 2021

(87) PCT Pub. No.: WO2021/025699
PCT Pub. Date: Feb. 11, 2021

(65) Prior Publication Data

US 2022/0228442 A1 Jul. 21, 2022

(51) Int. Cl.
*E21B 47/013* (2012.01)
*E21B 10/42* (2006.01)
(Continued)

(52) U.S. Cl.
CPC ..... *E21B 10/42* (2013.01); *E21B 10/46* (2013.01); *B22D 19/06* (2013.01); *B22F 2005/001* (2013.01); *E21B 47/013* (2020.05)

(58) Field of Classification Search
CPC ..... E21B 10/42; E21B 10/46; E21B 47/013; B22D 19/06; B22F 2005/001
See application file for complete search history.

(56) References Cited

U.S. PATENT DOCUMENTS 2,885,524 A 5/1959 Eisler
5,589,011 A 12/1996 Gonsalves
(Continued)

FOREIGN PATENT DOCUMENTS

WO 2012-071449 A2 5/2012
WO WO-2012071449 A2 * 5/2012 ..... E21B 10/00

OTHER PUBLICATIONS

International Search Report and Written Opinion for PCT Patent Application No. PCT/US2019/045699, mailed May 8, 2020; 13 pages.

(Continued)

*Primary Examiner* — Tara Schimpf
*Assistant Examiner* — Jennifer A Railey
(74) *Attorney, Agent, or Firm* — Michael Jenney; C. Tumey Law Group PLLC

(57) ABSTRACT

The present disclosure provides an earth-boring drill bit including a bit head and a shank. The shank includes a blank and a mandrel. The mandrel is concurrently formed by and secured to the blank by additive manufacturing. The mandrel includes a first region including a first alloy and a second region including a second alloy. The first alloy and the second alloy have a different modulus of elasticity, yield strength, resilience, ductility, hardness, fracture toughness, wear resistance, corrosion resistance, or erosion resistance. The disclosure also provides a mandrel wherein the second region comprises a sensor region or a fluid passageway having a geometry that is not obtainable in a mandrel that is cast, machined, or both. The disclosure additionally provides method of manufacturing such bits and mandrels.

20 Claims, 4 Drawing Sheets

(51) Int. Cl.

| | |
|---|---|
| ***E21B 10/46*** | (2006.01) |
| *B22D 19/06* | (2006.01) |
| *B22F 5/00* | (2006.01) |

(56) References Cited

U.S. PATENT DOCUMENTS

| | | | | |
|---|---|---|---|---|
| 6,209,420 | B1 | 4/2001 | Butcher et al. | |
| 6,655,481 | B2 | 12/2003 | Findley et al. | |
| 8,950,518 | B2 | 2/2015 | Lockwood et al. | |
| 2007/0102198 | A1 | 5/2007 | Oxford et al. | |
| 2008/0289880 | A1 | 11/2008 | Majagi et al. | |
| 2010/0193255 | A1 | 8/2010 | Stevens et al. | |
| 2010/0212961 | A1 | 8/2010 | Teodorescu | |
| 2011/0079446 | A1 | 4/2011 | Oxford | |
| 2013/0333950 | A1* | 12/2013 | Atkins | B29C 43/18 264/437 |
| 2016/0319605 | A1 | 11/2016 | Hough et al. | |
| 2017/0107764 | A1 | 4/2017 | Cook et al. | |
| 2018/0058148 | A1 | 3/2018 | Zhang et al. | |
| 2018/0320449 | A1 | 11/2018 | Zhang et al. | |
| 2020/0308954 | A1* | 10/2020 | Hird | E21B 47/017 |
| 2022/0228442 | A1 | 7/2022 | Voglewede et al. | |

OTHER PUBLICATIONS

International Search Report for PCT Patent Application No. PCT/US2019/045711, mailed May 7, 2020; 5 pages.
Written Opinion for PCT Patent Application No. PCT/US2019/045711, mailed May 7, 2020; 6 pages.
Office Action Summary for U.S. Appl. No. 17/615,627 dated Feb. 1, 2024. PDF file. 28 pages.

* cited by examiner

EARTH-BORING DRILL BIT MANDREL FORMED BY ADDITIVE MANUFACTURING

RELATED APPLICATIONS

This application is a U.S. National Stage Application of International Application No. PCT/US2019/045699 filed Aug. 8, 2019, which designates the United States.

TECHNICAL FIELD

The present disclosure relates generally to drilling tools, such as earth-boring drill bits that contain a mandrel.

BACKGROUND

Wellbores are most frequently formed in geological formations using earth-boring drill bits. Various types of such bits exist, but all of them experience some type of wear or fatigue from use that limits the overall life of the bit or the time it may spend downhole in the wellbore before being returned to the surface. The materials used in the bit and their ability to effectively cut different types of formations encountered as the wellbore progresses also sometimes necessitate removing the bit from the wellbore, replacing the bit or components of it, and returning the bit downhole to resume cutting.

Particularly as wellbores reach greater depths, the process of removing a bit from the wellbore and returning the bit to the surface becomes time consuming and costly. In addition, the bit and bit components themselves are costly and are time consuming to make or replace. As a result, those involved in designing, manufacturing, and operating earth-boring drill bits and their components spend a substantial amount of time developing ways to limit removal and return of a bit in a wellbore as well as ways to improve the life of the bit and its components. These efforts are complicated, however, by the fact that earth-boring drill bits and their components and operation are often quite complex, resulting in some improvements being found to be impractical to implement.

Drill bits and other downhole tools are typically formed by subtractive manufacturing, which involves removing material from a block of material. Matrix drill bits and other downhole tools made of multiple materials, are formed by placing loose reinforcement material, typically in powder form, into a mold and infiltrating the reinforcement material with a binder material such as a copper alloy. The reinforcement material infiltrated with the binder material may form a matrix bit body after solidification of the binder material with the reinforcement material.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
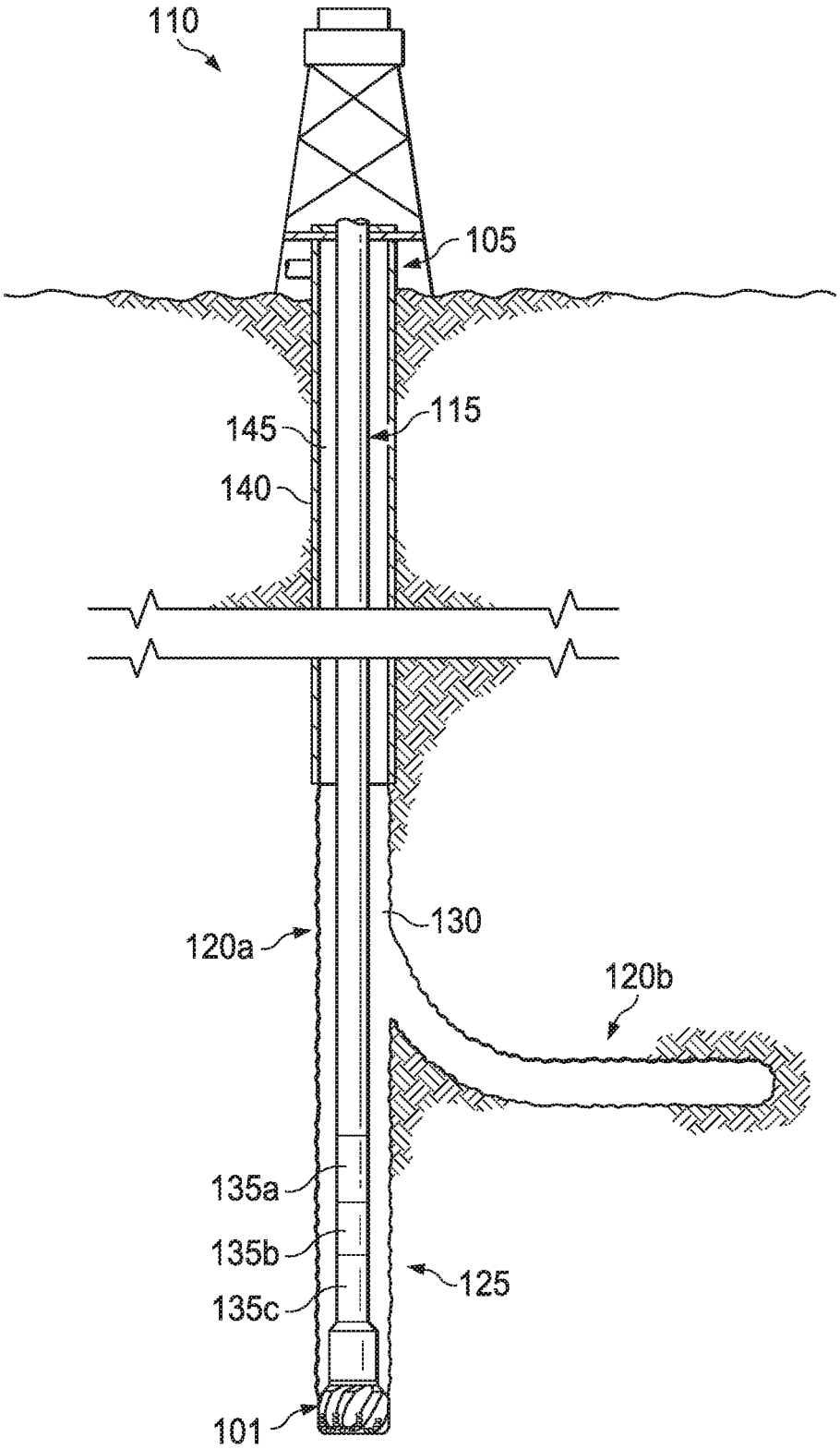
FIG. 1 is a schematic diagram of a drilling system in which an earth-boring drill bit according to the present disclosure may be used.

The present disclosure relates to an earth-boring drill bit containing a mandrel that includes at least two different steel alloys, two different copper (Cu) alloys, two different Nickel (Ni) alloys, including two different Cu—Ni alloys, or combinations of steel alloys, Cu alloys, and Ni alloys that are deposited in separate regions of the mandrel using additive manufacturing. The mandrel may be additively manufactured directly on a blank, thereby securing it to the blank. Such a mandrel may also include additively manufactured or non-additively manufactured embedded sensors or electronic components placed before, during, or after additive manufacturing, or sensor region compartments which may later house embedded sensors or electronic components. The remainder of the bit may be formed in any manner, including by molding, matrix infiltration, or further additive manufacturing.

Different steel alloys are designated by different numbers for steel in the Unified Numbering System (UNS) as established by the American Iron and Steel Institute (AISI) and Society of Automotive Engineers (SAE) as of May 1, 2019. Steel alloys in the UNS include D00001 to D99999, G00001 to G99999, H00001 to H99999, K00001 to K99999, 500001 to 599999, and T00001 to T99999.

Different Cu alloys are designated by different numbers for Cu alloys in the UNS as of May 1, 2019. Cu alloy grades in the UNS include C00001 to C99999. Cu—Ni alloys are typically found in UNS C00001 to C99999.

Different Ni alloys are designated by different numbers for Ni alloys in the UNS as of May 1, 2019. Ni alloy grades in the UNS include N00001 to N99999.

Alloys disclosed herein may be two-element alloys, such as steel formed solely from iron (Fe) and carbon (C), or multi-element alloys, such as steel including Fe, C, and at least one or any combinations of the following additional elements: manganese, nickel, chromium, molybdenum, vanadium, silicon, boron, aluminum, cobalt, copper, cerium, niobium, titanium, tungsten, tin, zinc, lead, or zirconium.

Different steel alloys may also be referred to as different grades of steel, meaning they have different compositions and mechanical properties. Different Cu alloys and Ni alloys also have different compositions and mechanical properties. Alloy mechanical properties of particular interest in earth-boring drill bits include modulus of elasticity, yield strength, resilience, ductility, hardness, fracture toughness, wear resistance, corrosion resistance, and erosion resistance. In some examples, one or more of these properties may be determined by reference to the relevant American Society for Testing and Materials (ASTM) standard.

It is useful to place different alloys having different mechanical properties in different regions of the mandrel of an earth-boring drill bit, but conventional techniques simply use one metal alloy for the entire mandrel. In addition, if a pre-formed mandrel with compartments for sensors or electronic components is welded to a blank, which is the traditional method of securing the mandrel to the blank, the mandrel may warp due to the heat generated by welding or post-welding heat treatment processes. If screws or bolts are used to secure the mandrel to the blank, then this negatively affects the stiffness of the overall assembly.

Additive manufacturing may be used to place different alloys in a mandrel, often in precise locations, and to form the mandrel on a blank, thereby securing it to the blank without the need for welding or screws. Additively manufactured mandrels may, therefore, differ from non-additively manufactured mandrels in that an additively manufactured mandrel may not be welded to a blank, and may lack welding material and structural features conferred by welding between the mandrel and the blank.

Additive manufacturing, as described in detail herein, may be used to manufacture a three-dimensional "3D" object, such as a mandrel, by depositing layers of material upon one another. The material deposited within a layer may vary based on location, allowing different alloys for different mandrel regions to be placed when a layer is placed. Additive manufacturing also readily allows for gaps in material deposited, such that fluid passageways and sensor region compartments to house embedded sensors or electronic components may be readily formed as well.

Fluid passageways in conventional mandrels are often lined with a material that differs from the material found in the bulk region of the mandrel. This lining is typically welded to the bulk material, or flame-sprayed onto the bulk material. Both processes are heat-intensive and can cause the same type of problems as welding the mandrel onto a blank. Additively manufactured mandrels may simply place the fluid passageway lining material as a second region at the same time the first, bulk material region is placed, joining the first and second regions as part of the additive manufacturing process. Alternatively, if a pre-formed fluid passageway lining is used, it may simply be placed appropriately adjacent to the bulk region during additive manufacturing and will become joined to the adjacent additively manufactured material, typically the bulk material, during the additive manufacturing process. In either case, an additively manufactured drill bit lacks welding material and structural features conferred by welding or flame-spraying between the material lining the fluid passageway and the underlying, adjacent mandrel material, typically the bulk material.

Sensor region compartments also differ from conventional bits in that these compartments may be lined by a sensor region material. In addition, in an additively manufactured mandrel, a sensor may be placed while the mandrel is being formed, allowing it to be in locations not possible in conventional mandrel. Furthermore, because compartments for sensors in conventional mandrels must be machined into the mandrel after the bulk material has been cast, there is a hole leading from the outside of the mandrel to the sensor. This hole must be plugged to protect the sensor from downhole fluids. Accordingly, a conventional mandrel contains a plug blocking exterior access to the sensor. Additively manufactured bits may lack such a plug and may have no passageway leading from the sensor to the exterior of the mandrel.

Finally, a conventional mandrel must first be cast, and then any fluid passageways or sensor cavities or regions that could not be shaped by the mold or mold blanks, allowing for removal of the mandrel from the mold and allowing for removal of the mold blanks, must be machined into the mold from an exterior surface, and can therefore only be straight holes machined in from the exterior. This limits the geometry of fluid passageways or sensor cavities or regions. An additively manufactured mandrel may contain a fluid passageway, a sensor cavity, or a sensor region having a geometry that is not obtainable in a mandrel that is cast, machined, or both.

Additive manufacturing may use one technique or combinations of two or more techniques. Additive manufacturing techniques that may be used include melting in layers or spray melting using a wire or powder. By way of example, two wires formed from different alloys having different mechanical properties could be used to form a layer. Other additive manufacturing techniques can also be used, including any suitable technique that is capable of building up layers of materials to form an object. In general, additive manufacturing may include direct metal laser sintering (DMLS), electron beam melting (EBM), selective heat sintering (SHS), selective laser melting (SLM), selective laser sintering (SLS), or fused filament fabrication, or any combinations thereof.

The present disclosure and its advantages are best understood by referring to FIGS. 1 through 4, where like numbers are used to indicate like and corresponding parts.

FIG. 1 shows a drilling system 100 including an earth-boring drill bit 101 according to the present disclosure.

Drilling system 100 may include well surface or well site 105. Various types of drilling equipment such as a rotary table, mud pumps and mud tanks (not expressly shown) may be located at a well surface or well site 105. For example, well site 105 may include drilling rig 110 that may have various characteristics and features associated with a "land drilling rig." However, drill bits according to the present disclosure may be satisfactorily used with drilling equipment located on offshore platforms, drill ships, semi-submersibles and drilling barges (not expressly shown).

Drilling system 100 may include drill string 115 associated with drill bit 101 that may be used to form a wide variety of wellbores or bore holes such as generally vertical wellbore 120*a* or generally horizontal wellbore 120*b*. Various directional drilling techniques and associated components of bottom hole assembly (BHA) 125 of drill string 115 may be used to form generally horizontal wellbore 120*b*. For example, lateral forces may be applied to drill bit 101 at proximate kickoff location 130 to form generally horizontal wellbore 120*b* extending from generally vertical wellbore 120*a*. A wellbore is drilled to a drilling distance, which is the distance between the well surface and the furthest extent of the wellbore, and which increases as drilling progresses. As drill bit 101 is rotated during a drilling operation cutting elements (shown in FIG. 3 as element 235) come into contact with the formation, in order to remove material of the formation being drilled.

BHA 125 may be formed from a wide variety of components configured to form a wellbore. For example, components 135*a*, 135*b* and 135*c* of BHA 125 may include, but are not limited to, drill bit, such as drill bit 101, drill collars, rotary steering tools, directional drilling tools, downhole drilling motors, reamers, hole enlargers or stabilizers. The number of components such as drill collars and different types of components 135 included in BHA 125 may depend upon anticipated downhole drilling conditions and the type of wellbore that will be formed by drill string 115 and drill bit 101.

A wellbore may be defined in part by casing string 140 that extends from well site 105 to a selected downhole location. Portions of a wellbore that do not include casing string 140 may be described as "open hole." Drilling fluid may be pumped from well site 105 through drill string 115 to drill bit 101. Such drilling fluids may be directed to flow from drill string 115 to respective nozzles (shown in FIGS.

2 and 3 as elements 245) included in earth-boring drill bit 101. The drilling fluid may be circulated back to well surface 105 through annulus 145.

Drilling system 100 also typically includes monitoring equipment able to measure conditions within drill bit 101 or wellbore 120. This equipment is frequently located in BHA 125, but may also be located in drill bit 101.

Figure 2:
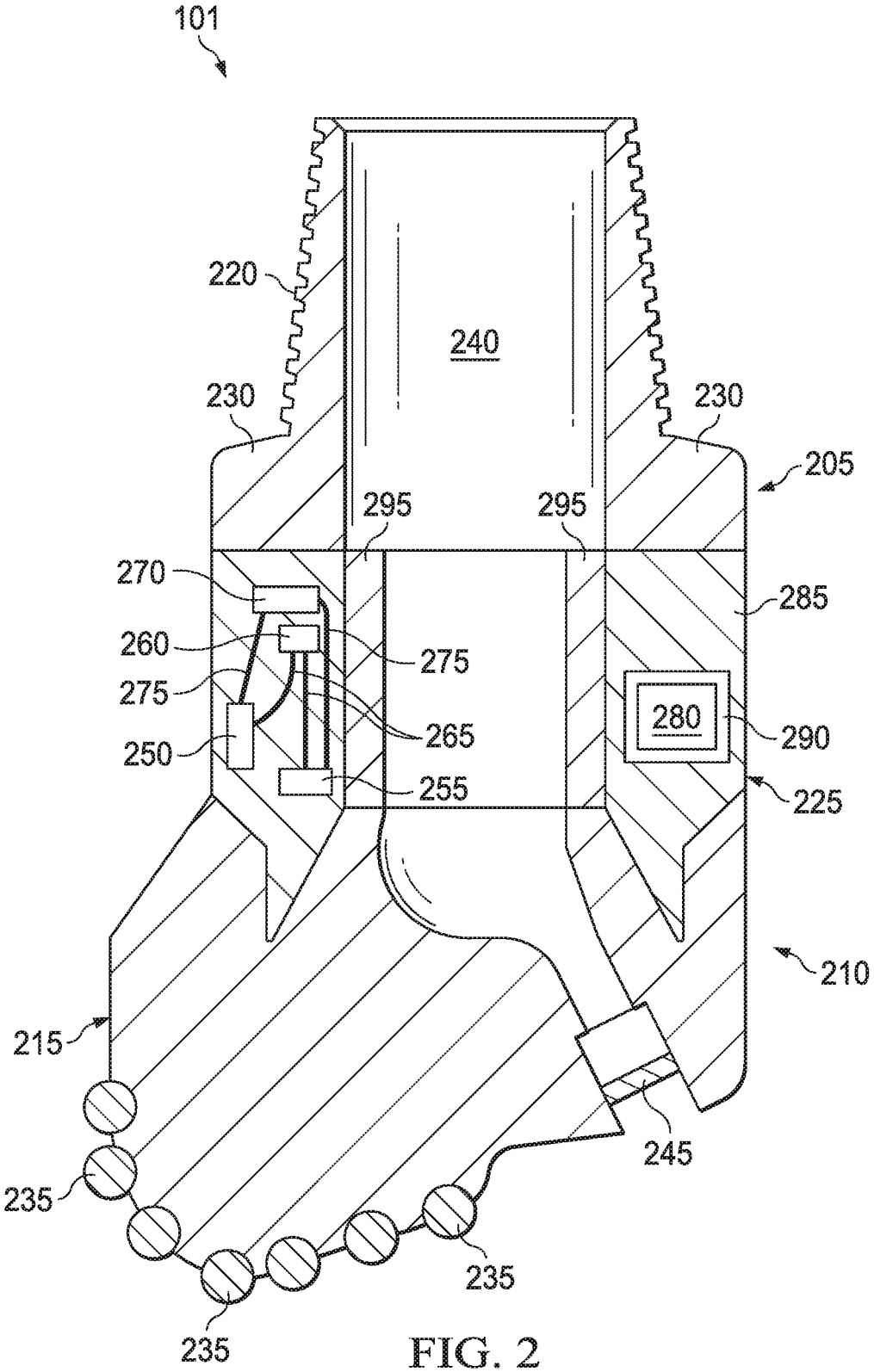
FIG. 2 is a cross-section view of an earth-boring drill bit having a mandrel with different alloys of metal, such mandrel may be formed using additive manufacturing technology of the present disclosure.
Figure 3:
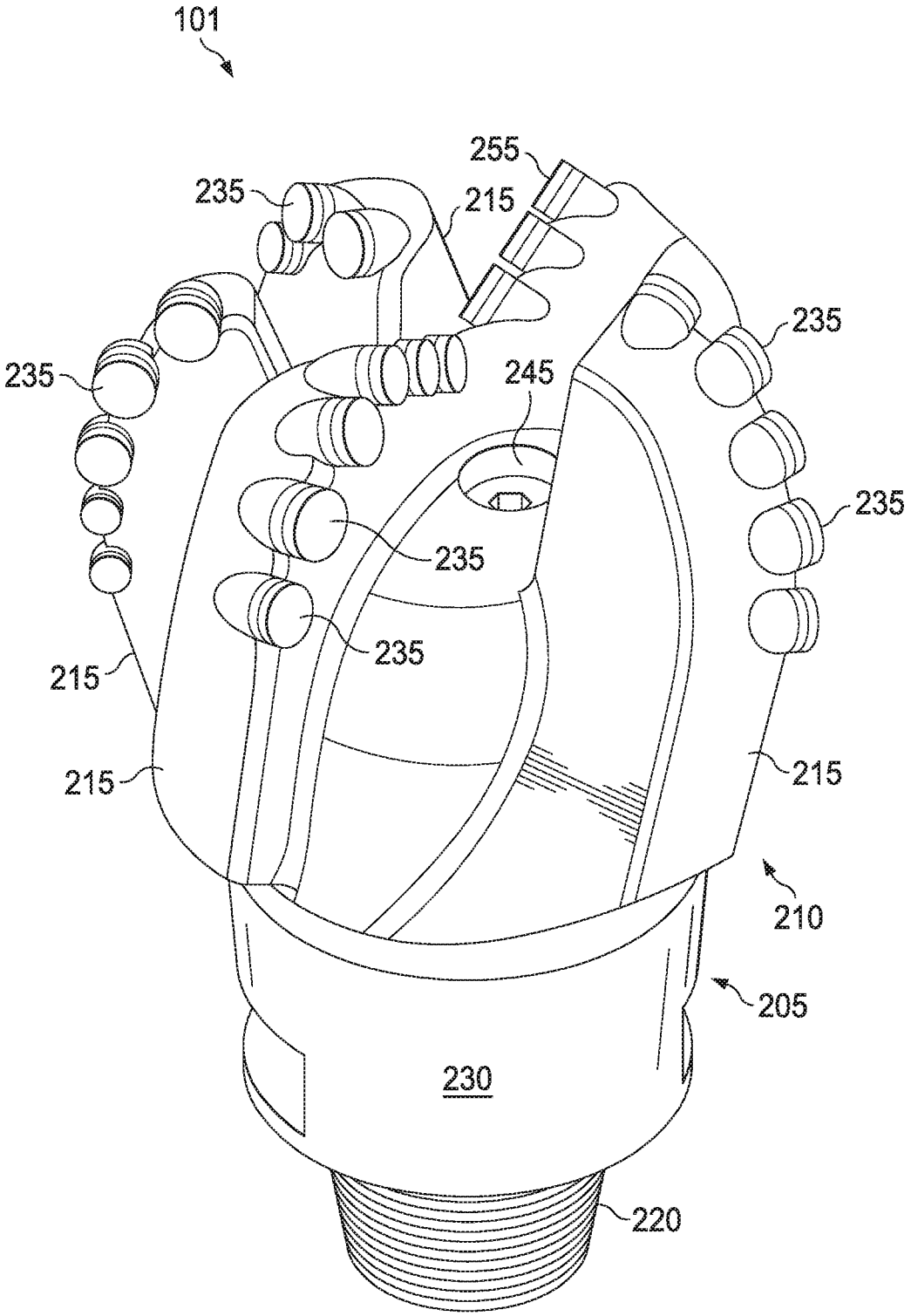
FIG. 3 is a schematic drawing showing a perspective view of the earth-boring drill bit of FIG. 2, the mandrel of which may be formed using additive manufacturing technology of the present disclosure.

FIG. 2 is a cross-section view of a fixed-cutter type of earth-boring drill bit 101 and FIG. 3 is a perspective view of the same drill bit 101. Although a fixed-cutter drill bit is used throughout this specification to illustrate the principles disclosed herein, these principles may be applied, using the description provided herein, by one of ordinary skill in the art to other types of earth-boring drill bits or downhole tools that cut into a formation, such as roller cone drill bits, coring bits, and reamers.

As illustrated in FIGS. 2 and 3, drill bit 101 includes shank 205 and bit head 210.

Shanks, such as shank 205, are conventionally secured to bit head 210 by welding or by placing shank 205 in a mold, filling the mold with a matrix material, then infiltrating the matrix materials with a binder. These and other methods of securing a bit head to the shank, including new methods of securing the bit head to the shank by additive manufacturing, may be used in conjunction with the present disclosure.

Shank 205 may include a blank 230 and a threaded portion 220 that is able to connect drill bit 101 to drill string 115 (as illustrated in FIG. 1). Threaded portion 220 may be an American Petroleum Institute (API) connection. Shank 205 may further include a mandrel 225 that is formed on and secured to blank 230 by additive manufacturing. Threaded portion 220 may also be formed on and secured to blank 230 by additive manufacturing. The blank 230 and threaded portion 220 may be formed from any suitable material, such as steel.

Bit head 210 includes cutters 235 located around the exterior of blades 215. Bit head 210, in this example, is illustrated with five blades 215. Drill bit 101 may include more or fewer blades.

Drill bit 101 further includes fluid passage 240, which passes through shank 205 and bit head 210 to nozzle 245. Fluid passage 240 allows drilling fluid to pass from drill string 115 (as shown in FIG. 1) through drill bit 101, where it exits through nozzle 245 and is circulated back to well surface 105 (as shown in FIG. 1) through annulus 145 (as shown in FIG. 1). Fluid passage 240 may be formed by leaving gaps in the alloy deposited using additive manufacturing.

Mandrel 225 may extend into bit head 210 as illustrated, or it may end at a generally planar boundary with bit head 210 (not shown).

Mandrel 225 may further include a gap for fluid passage 240 or other fluid passages, such as lubrication system passages if the earth-boring drill bit is a roller cone drill bit.

Mandrel 225 also provides an excellent location for embedded sensors or electronic components, many of which are conventionally located in the BHA. Embedded sensors or electronic components may include directional drilling equipment as well as monitoring equipment able to measure conditions within drill bit 101 or wellbore 120 (shown in FIG. 1). Example embedded sensors or electronic components include thermal sensors, force sensors, weight sensors, torque sensors, pressure sensors, dielectric constant sensors (e.g. for detecting lubricant quality in roller cone drill bits), radiation sensors, gamma-ray sources and sensors, resistivity sensors, borehole calipers, sonic sensors, nuclear magnetic resonance (NMR) sensors, gyroscopes, accelerometers, magnetometers, processors, electronic memory, other printed electronic circuits, electronically conductive insulated wiring, mud pulsers, and power sources, such as batteries.

In the example shown in FIGS. 2 and 3, mandrel 225 includes embedded strain sensor 250 and embedded thermal sensor 255, which are coupled to a power source 260 by electronically conductive insulated wiring 265 and to processor 270 by electronically conductive insulated wiring 275. Mandrel 225 further includes imbedded gyroscope 280 which includes an internal power source and processor (not separately shown).

Mandrel 225 further includes at least two different regions formed from different alloys having different mechanical properties. These different mechanical properties may be selected based on the needs of the different regions.

For example, mandrel 225 may include a bulk region 285 formed from an alloy having a higher yield strength, a higher resilience, or both than that used to form other regions of mandrel 225. The alloy used for bulk region 285 may further have a higher ductility. For example, if the alloy is steel, then it may be a low alloy steel having a C concentration of less than 0.3%, particularly between 0.04% and 0.3%, inclusive. The steel may be a two-component alloy or a multi-component alloy.

Mandrel 225 may further include a sensor region 290 surrounding a sensor, such as gyroscope 280. This sensor region 290 formed from an alloy having a higher modulus of elasticity than other alloys present in mandrel 225. For example, the modulus of elasticity may be between 29,000,000 psi and 31,000,000 psi, inclusive, between 29,500,000 psi and 30,500,000 psi, inclusive, or between 29,900,000 psi and 30,100,000 psi, inclusive. For example, if the alloy is steel, then it may be an alloy having a C concentration of between 0.4% and 0.8%, inclusive. The steel may be a two-component alloy or a multi-component alloy. For example, it may be UNS G10180.

Mandrel 225 may also include a strain sensor 250. The strain sensor may be formed from an alloy having a lower modulus of elasticity than the alloy forming bulk region 285. In some examples, it may even be an alloy of a different metal. For example, if bulk region 285 is formed from steel, then strain sensor 250 may be formed from a Cu—Ni alloy. Strain sensor 250 may be additively manufactured at the same time the surrounding regions of mandrel 225 are additively manufactured. Alternatively, strain sensor 250 may be non-additively manufactured and placed in mandrel 225 after other regions of mandrel 225 are additively manufactured. Strain sensor may be located within a load path of mandrel 225 or drill bit 101. For example, if strain sensor detects an axial force, then any location in mandrel 225 is acceptable. However, if strain sensor detects torque, then it may be located close to the outer edge of mandrel 225 or drill bit 101.

Mandrel 225 may also include an erosion-resistant region 295 that lines fluid passage 240. Erosion-resistant region 295 may be formed from an alloy having an equal or higher yield strength, equal or higher resilience, or both than the alloy forming sensor region 290 and a higher hardness than the other alloys present in mandrel 225. For example, if the alloy is steel, then it may be an alloy having a C concentration of 0.6% or greater, such as between 0.6% and 1.5%, inclusive. In some steel alloys, particularly those with a C concentration that overlaps with that of alloys used for other regions of mandrel 225, erosion-resistance may be due to the presence of materials other than C, such as erosion-resistance additives, including hard particles.

Thermal sensor 255 is simply adjacent to the bulk region 285 to allow it to more accurately record actual temperatures in drill bit 101.

Figure 4:
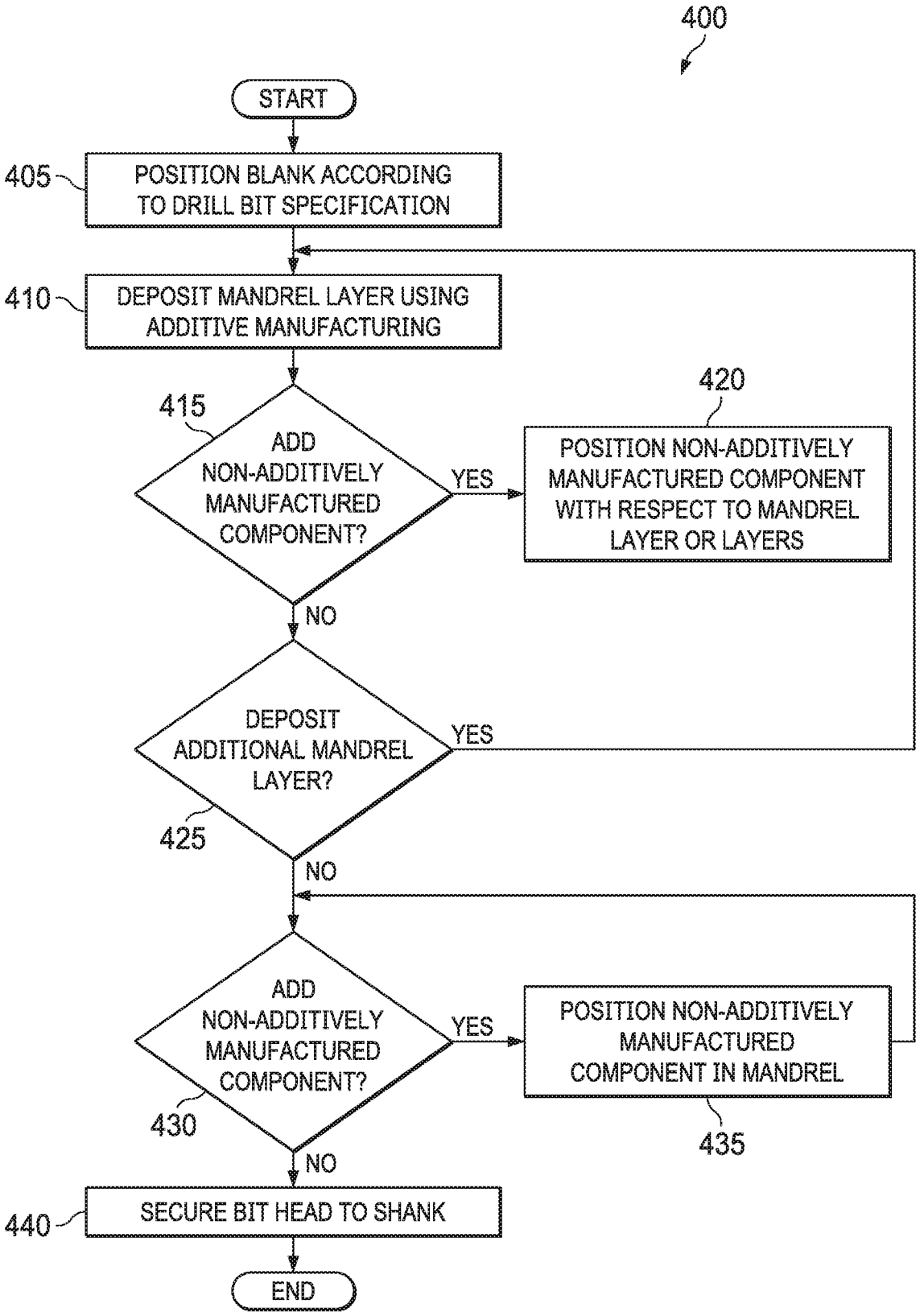
FIG. 4 is a flow chart of a method of using additive manufacturing technology to form an earth-boring drill bit with a mandrel having different alloys of metal, according to the present disclosure.

FIG. 4 is a flow chart of a method 400 of manufacturing an earth-boring drill bit including a mandrel manufactured using additive manufacturing. The earth boring-drill bit may be any such bit as disclosed herein, including drill bit 101. The earth-boring drill bit includes different regions subjected to different mechanical forces and stresses or that benefit from different properties due to the presence of different embedded sensors or electronic components. These different regions are formed from different alloys of steel, different Cu alloys, different Ni alloys, or combinations of steel, Cu alloys, and Ni alloys. Any alloys suitable for formation of the region using additive manufacturing may be used. In particular, alloys that may be formed into wires or particles and heated may be used.

The drill bit manufactured in method 400 is in accordance with a drill bit specification. The drill bit specification identifies regions of the mandrel to be formed by additive manufacturing and the alloy to form each region, as well as any gaps within the layer and the boundaries of the layer for each of the plurality of layers deposited by additive manufacturing. The drill bit specification further identifies the location of each alloy in each layer. The drill bit specification may further identify additively or non-additively manufactured drill bit components, such as the blank or embedded sensors or electronic components, and specify the location of such components and whether they are to be added to the mandrel before, during, or after a layer deposited by additive manufacturing. The drill bit specification may further indicate the shape, location, composition, and formation methods of the bit head.

In step 405, a blank is positioned with respect to the additive manufacturing equipment in accordance with the drill bit specification such that additive manufacturing layers will be deposited in the correct locations on the blank.

In step 410, a mandrel layer is deposited using additive manufacturing according to the drill bit specification. The layer may include only one alloy, or more than one alloy. The alloy or alloys are deposited in locations specified by the drill bit specification. If the alloy or alloys are deposited on the blank, they may be secured to that component through the additive manufacturing process.

In step 415, it is determined, through reference to the drill bit specification, whether a non-additively manufactured component should be added before further mandrel layers are formed using additive manufacturing.

If a non-additively manufactured component should not be added, then the method proceeds to step 425.

If a non-additively manufactured component should be added, then in step 420 the non-additively manufactured component is positioned with respect to the mandrel layer or layers according to the drill bit specification. For example, sensors or electronics that will be embedded in the mandrel may be placed prior to completion of additive manufacturing. If sensitive components are placed prior to or during additive manufacturing, additive manufacturing processes and conditions may be selected so as to not damage the components, for example by high temperature. The process then proceeds to step 425.

In step 425, it is determined, through reference to the drill bit specification, whether an additional mandrel layer should be deposited using additive manufacturing.

If an additional layer should not be deposited, then the method proceeds to step 430.

If an additional layer should be deposited, then the method proceeds to step 410. This process repeats until a plurality of layers have been deposited to form the mandrel.

In step 430, it is determined, through reference to the drill bit specification, whether a non-additively manufactured component should be added to the mandrel for which additive manufacturing is complete.

If no non-additively manufactured component should be added, the method proceeds to step 440.

If a non-additively manufactured component should be added, then in step 435 the non-additively manufactured component is positioned in the mandrel according to the drill bit specification. For example, an external sensor may be positioned in a gap in the exterior of the mandrel.

Then, the process returns to step 430.

In step 440, a bit head is secured to the shank, including the mandrel. This may be accomplished in a conventional manner, such as by welding or forming a matrix bit head around the mandrel, or by less conventional methods, such as further additive manufacturing. In fact, portions of the bit head formed by additive manufacturing may also be deposited in layers that also contain portions of the mandrel.

Additive manufacturing used in the above method or to form any earth-boring drill bit disclosed herein may involve depositing an alloy, then treating the alloy to form a layer and secure the layer to any underlying layer or adjacent non-additively manufactured components. For example, if an alloy is deposited as a wire or powder, it may then be heated to its melting point so that the wire or powder forms a continuous layer. However, the alloy is typically not melted for a duration of time sufficient to cause it to flow into locations not specified in the drill bit specification. In addition, in layers with more than one alloy, the alloys are typically not melted for a duration of time sufficient to mix except in a very narrow boundary region, where they are adjacent to one another. For example, the alloys may not mix other than in a boundary region between 0.01 mm and 5 mm in width, inclusive.

A variety of additive manufacturing techniques may be used to form a mandrel as disclosed herein. For example, additive manufacturing may include 3D printing, particularly powder bed fusion techniques such as direct metal laser sintering (DMLS), electron beam melting (EBM), selective heat sintering (SHS), selective laser melting (SLM), selective laser sintering (SLS), or fused filament fabrication (also known as fused deposition modeling and filament freeform fabrication), or any combinations thereof. A single drill bit may be formed using different additive manufacturing techniques.

Additive manufacturing used in the above method or to form any mandrel disclosed herein may be performed using additive manufacturing equipment. This additive manufacturing equipment may include precision deposition equipment, such as a 3D printing print head, and other equipment to finish a 3D printed layer, such as heating equipment, that is controlled by a processor that is able to execute additive manufacturing instructions stored in memory communicatively coupled to the processor. The additive manufacturing instructions reflect at least the additive manufacturing portions of the drill bit specification, so that, when executed by the processor, the precision deposition equipment deposits the correct alloy in the correct form (e.g. a wire or a powder) in the correct location of the drill bit being formed, and any other equipment, such as heating equipment, finishes the layer appropriately.

The additive manufacturing instructions may themselves be produced by a processor (which may be the same processor as in the additive manufacture equipment or a different processor) that executes conversion instructions that cause it to examine the drill bit specification stored in communicatively coupled memory, which may be, for example, a computer aided drawing (CAD) file or set of files, and prepare the additive manufacture instructions so that the additive manufacturing equipment may produce a drill bit in accordance with the drill bit specification.

The additive manufacturing equipment may further include process control equipment that can, for example, scan a layer once deposited to determine if it appears to be in the correct location. This may allow drill bits with additive manufacturing errors to be detected quickly, when corrective measures are still possible, or when they can be discarded with minimal waste of material.

In an Embodiment A, the present disclosure provides an earth-boring drill bit including a bit head and a shank. The shank includes a blank and a mandrel. The mandrel is concurrently formed by and secured to the blank by additive manufacturing. The mandrel includes a first region including a first alloy and a second region including a second alloy. The first alloy and the second alloy have a different modulus of elasticity, yield strength, resilience, ductility, hardness, fracture toughness, wear resistance, corrosion resistance, or erosion resistance.

In an embodiment B, the present disclosure provides a mandrel. The mandrel may be used in an earth-boring drill bit, such as that of Embodiment A. The mandrel includes a bulk region including a first alloy; and a second region including a second alloy. The second region includes a sensor region or a fluid passageway having a geometry that is not obtainable in a mandrel that is cast, machined, or both. The first alloy and the second alloy have a different modulus of elasticity, yield strength, resilience, ductility, hardness, fracture toughness, wear resistance, corrosion resistance, or erosion resistance.

In an Embodiment C, the present disclosure provides a method that may be used to manufacture an earth-boring drill bit as disclosed in Embodiment A. The method includes depositing on the blank a plurality of mandrel layers using additive manufacturing according to a drill bit specification that identifies the first region and the second region in each layer, a location of the first alloy in each layer, a location of the second alloy in each layer, and a location of a boundary of each layer; and securing the shank to the bit head.

The disclosure also provides additional embodiments, which may be combined with Embodiment A, Embodiment B, Embodiment C, one another, and any other parts of the disclosure contained herein unless clearly mutually exclusive. These embodiments include:

i) the first alloy may be steel, the second alloy may be steel, and the first alloy and the second alloy may have different grades;

ii) the first region may be a bulk region and the first alloy may have a higher yield strength, a higher resilience, or both as compared to the second alloy;

iii) the mandrel may further include an embedded sensor or electronic component and the second region may be a sensor region or the mandrel may further include an embedded sensor or electronic component within the sensor region;

iv) the second alloy may have a higher modulus of elasticity than the first alloy;

v) the first alloy may be steel, the second alloy may be a copper-nickel (Cu—Ni) alloy, and the second region may include a strain sensor.

vi) the second alloy may have an equal or higher yield strength, equal or higher resilience, or both and a higher hardness than the first alloy.

vii) the mandrel may further include a fluid passage and the second alloy may be located around at least a portion of the fluid passage;

viii) the mandrel may further include a plurality of additional regions, each formed from an additional alloy having a different modulus of elasticity, yield strength, resilience, ductility, hardness, fracture toughness, wear resistance, corrosion resistance, or erosion resistance as compared to one another and the first alloy and the second alloy;

ix) the mandrel may not include a welding material and structural features conferred by welding or flame-spraying;

x) the drill bit specification may further identify a non-additively manufactured component and specify a location for the non-additively manufactured component, and the method may include placing or adding the non-additively manufactured component in the specified location.

xi) the non-additively manufactured component may be an embedded sensor or electronic component;

xii) the embedded sensor or electronic component may include a strain sensor;

xiii) the drill bit specification may further identify a location of a gap within at least a portion of the plurality of mandrel layers;

xiv) additive manufacturing may include direct metal laser sintering (DMLS), electron beam melting (EBM), selective heat sintering (SHS), selective laser melting (SLM), selective laser sintering (SLS), or fused filament fabrication, or any combinations thereof;

xv) additive manufacturing may include placing a wire or powder of the first alloy or the second alloy in its location in each layer;

xvi) the first alloy and the second alloy may be adjacent in the plurality of layers and mix only in a boundary region that is between 0.01 mm and 5 mm in width, inclusive.

Although the present disclosure and its advantages have been described in detail, it should be understood that various changes, substitutions and alterations can be made herein without departing from the spirit and scope of the disclosure as defined by the following claims. For example, alloys other than steel, Cu alloys, or Ni alloys, such as Chromium alloys, as designated by different UNS numbers, may be used. It is intended that the present disclosure encompasses such changes and modifications as fall within the scope of the appended claims.

What is claimed is:

1. An earth-boring drill bit comprising:

a shank including a blank and a threaded portion, wherein the threaded portion is formed on and secured to the blank by additive manufacturing; and a mandrel concurrently formed by and secured to the blank by additive manufacturing, wherein the mandrel includes:

a bulk region including a first alloy; and a sensor region including a second alloy, wherein the sensor region is formed within the bulk region; wherein the sensor region includes a sensor region compartment enclosed by the sensor region, wherein the first alloy and the second alloy have a different modulus of elasticity, yield strength, resilience, ductility, hardness, fracture toughness, wear resistance, corrosion resistance, or erosion resistance, wherein the first alloy has a higher yield strength and hardness than the second alloy;

an embedded sensor disposed within the sensor region compartment; and a bit head secured to the mandrel, wherein the bit head includes cutters configured to engage a downhole formation.

2. The earth-boring drill bit of claim 1, wherein the first alloy is steel, the second alloy is steel, and the first alloy and the second alloy have different grades.

3. The earth-boring drill bit of claim 1, wherein the first alloy of the bulk region has a higher resilience than the second alloy of the sensor region.

4. The earth-boring drill bit of claim 1, wherein the embedded sensor includes a gyroscope.

5. The earth-boring drill bit of claim 1, wherein the second alloy has a higher modulus of elasticity than the first alloy.

6. The earth-boring drill bit of claim 1, wherein the first alloy is steel, the second alloy is a copper-nickel (Cu-Ni) alloy, and the sensor region comprises a strain sensor.

7. The earth-boring drill bit of claim 1, further comprising at least one embedded sensor and electrical components embedded within the mandrel, wherein the electrical components include a power source, electronically conductive insulated wiring, and a processor.

8. The mandrel earth-boring drill bit of claim 1, further comprising a strain sensor additively manufactured within the bulk region of the mandrel, wherein the strain sensor includes an alloy having a lower modulus of elasticity than the first alloy of the bulk region.

9. The mandrel earth-boring drill bit of claim 1, wherein the mandrel further comprises an erosion-resistant region including a third alloy that lines a fluid passageway extending through the mandrel wherein the third alloy has a higher yield strength, resilience, and hardness, than the first alloy and the second alloy.

10. A mandrel for an earth-boring drill bit, the mandrel comprising:

a bulk region including a first alloy;

a sensor region including a second alloy, wherein the sensor region is formed within the bulk region; wherein the sensor region includes a sensor region compartment enclosed by the sensor region, and wherein the first alloy and the second alloy have a different modulus of elasticity, yield strength, resilience, ductility, hardness, fracture toughness, wear resistance, corrosion resistance, or erosion resistance, wherein the first alloy has a higher yield strength and hardness than the second alloy; and an erosion-resistant region including a third alloy that lines a fluid passageway extending through the mandrel, and wherein the third alloy has a higher hardness than the first alloy and the second alloy, and wherein the bulk region, the sensor region, and the erosion-resistant region are formed via additive manufacturing.

11. The mandrel of claim 10, wherein the bulk region encloses the sensor region.

12. The mandrel of claim 10, further comprising an embedded sensor or electronic component disposed within the sensor region compartment.

13. A method of manufacturing an earth-boring drill bit, the drill bit comprising:

a shank including a blank and a threaded portion, wherein the threaded portion is formed on and secured to the blank by additive manufacturing;

a mandrel concurrently formed by and secured to the blank of the shank by additive manufacturing, wherein the mandrel includes:

a bulk region including a first alloy;

a sensor region including a second alloy wherein the sensor region is formed within the bulk region; wherein the sensor region includes a sensor region compartment enclosed by the sensor region, and wherein the first alloy has a higher yield strength and hardness than the second alloy; and an erosion-resistant region including a third alloy that lines a fluid passageway extending through the mandrel, wherein the first alloy, the second alloy, and the third alloy have a different modulus of elasticity, yield strength, resilience, ductility, hardness, fracture toughness, wear resistance, corrosion resistance, or erosion resistance, and wherein the third alloy has a higher hardness than the first alloy and the second alloy; and a bit head secured to the mandrel, wherein the bit head includes cutters configured to engage a downhole formation;

the method comprising:

depositing on the blank a plurality of mandrel layers using additive manufacturing according to a drill bit specification that identifies the bulk region, the sensor region, and the erosion-resistant region in each layer, a location of the first alloy in each layer, a location of the second alloy in each layer, a location of the third alloy in each layer, and a location of a boundary of each layer; and securing the shank to the bit head.

14. The method of claim 13, wherein the drill bit specification further identifies a non-additively manufactured component and specifies a location for the non-additively manufactured component, and the method includes placing or adding the non-additively manufactured component in the sensor region compartment.

15. The method of claim 14, wherein the non-additively manufactured component is an embedded sensor or electronic component.

16. The method of claim 15, wherein the embedded sensor or electronic component comprises a strain sensor.

17. The method of claim 13, wherein the drill bit specification further identifies a location of a gap within at least a portion of the plurality of mandrel layers.

18. The method of claim 13, wherein additive manufacturing comprises direct metal laser sintering (DMLS), electron beam melting (EBM), selective heat sintering (SHS), selective laser melting (SLM), selective laser sintering (SLS), or fused filament fabrication, or any combinations thereof.

19. The method of claim 13, wherein additive manufacturing comprises placing a wire or powder of the first alloy or the second alloy in its location in each layer.

20. The method of claim 13, the first alloy and the second alloy are adjacent in the plurality of layers and mix only in a boundary region that is between 0.01 mm and 5 mm in width, inclusive.

* * * * *